US006547531B1

(12) United States Patent
Cumbo et al.

(10) Patent No.: US 6,547,531 B1
(45) Date of Patent: Apr. 15, 2003

(54) VARIABLE-DISPLACEMENT AXIAL PISTON PUMP

(76) Inventors: Terry L. Cumbo, 11930 State Route 274, Lewistown, OH (US) 43333; Robert C. Hodges, 6360 Herbmoor, Troy, MI (US) 48098; Anthony L. Reilly, 9562 Marysville Rd., Ostrander, OH (US) 43061

( * ) Notice: Subject to any disclaimer, the term of this patent is extended or adjusted under 35 U.S.C. 154(b) by 0 days.

(21) Appl. No.: 10/050,466

(22) Filed: Jan. 16, 2002

(51) Int. Cl.[7] ..... F04B 49/12
(52) U.S. Cl. ..... 417/63; 417/222.1
(58) Field of Search ..... 60/449, 452; 92/12.2; 417/63, 222.1, 269

(56) References Cited

U.S. PATENT DOCUMENTS 4,265,603 A * 5/1981 Chiyoda et al. ..... 417/63
4,393,966 A * 7/1983 Kono et al. ..... 417/269
5,073,091 A * 12/1991 Burgess et al. ..... 417/222.1
6,102,490 A * 8/2000 Ko ..... 417/222.1
6,375,433 B1 * 4/2002 Du et al. ..... 417/222.1

FOREIGN PATENT DOCUMENTS

JP 5-231306 * 9/1993

* cited by examiner

*Primary Examiner*—Michael Koczo
(74) *Attorney, Agent, or Firm*—Thomas S. Baker, Jr.

(57) ABSTRACT

A conventional variable-displacement, axial piston-type hydraulic fluid pump having a pump housing is provided with co-operating pump rotational speed, thrust plate position, and working pressure operating-condition sensor assemblies that are partially contained within the pump housing, that are partially contained within a separate position sensor housing which is removably secured to the pump housing, and that are sealed against high-pressure fluid leakage using only static resilient fluid pressure seals.

1 Claim, 5 Drawing Sheets

VARIABLE-DISPLACEMENT AXIAL PISTON PUMP

CROSS-REFERENCES

None

FIELD OF THE INVENTION

This invention relates generally to fluid pumps, and particularly concerns an improved variable-displacement axial piston pump that advantageously achieves reduced auxiliary sensor fluid leakage over prolonged periods of pump operating life, and that also facilitates efficient pump assembly operations.

BACKGROUND OF THE INVENTION

It has become increasingly important that the pump component of high-pressure hydraulic systems include one or more sensors that continuously monitor the status of pump operation. In the case of high-pressure hydraulic systems utilizing a variable-displacement, axial piston-type pump it is common practice to measure pump volumetric pumping rate by sensing both pump rate of rotation and pump thrust plate angular position. In addition it has been common practice to also provide the variable-displacement, axial piston-type pump component of the hydraulic system with included pressure sensors that monitor pump output (working) pressure and pump load pressure with the latter being a feedback pressure utilized for effecting control of the relative angular position of the pump thrust plate element.

Heretofore, it also has been common practice to utilize both dynamic and static resilient pressure seals in connection with mounting the different pump operating condition sensors on the pump with the dynamic resilient seals being in contact with sensor rotating elements and thus subjected to wear erosion and consequent fluid leakage over extended periods of pump operation.

It is therefore a primary objective of the present invention to provide a variable-displacement, axial piston-type hydraulic pump with an installation of multiple sensors that utilizes static resilient pressure seals exclusively.

It also is an objective of the present invention to provide a variable-displacement, axial piston-type hydraulic pump with multiple sensors that may be efficiently constructed and installed in the pump.

Other objectives of the invention will become apparent from consideration of the detailed descriptions, drawings, and claims which follow.

SUMMARY OF THE INVENTION

The instant hydraulic pump invention essentially is comprised of a conventional variable-displacement hydraulic fluid pump contained within a pump housing and of co-operating pump operating-condition sensor assemblies contained partially within the pump housing and partially within a separate position sensor housing that is removably secured to the pump housing. The hydraulic fluid pump includes multiple variable-stroke fluid-pumping pistons contained within a rotationally-driven pump barrel, an angularly-adjustable piston thrust plate co-operating with the fluid-pumping pistons to vary pump volumetric output, and various conventional internal fluid passageways.

The co-operating pump operating-condition sensor assemblies include a piston thrust plate position sensor assembly responsive to pump thrust plate position changes, a pump barrel rotational speed sensor assembly, and a pump working or output pressure sensor assembly. Advantageously, the installation of pump operating-condition sensor assemblies may optionally include a pump load feedback pressure sensor assembly. In each instance only a static (i.e., non-eroded) resilient pressure seal is utilized to seal the pump and position sensor assembly housings against fluid leakage from around the sensor body.

DESCRIPTION OF THE PREFERRED EMBODIMENT

Figure 1:
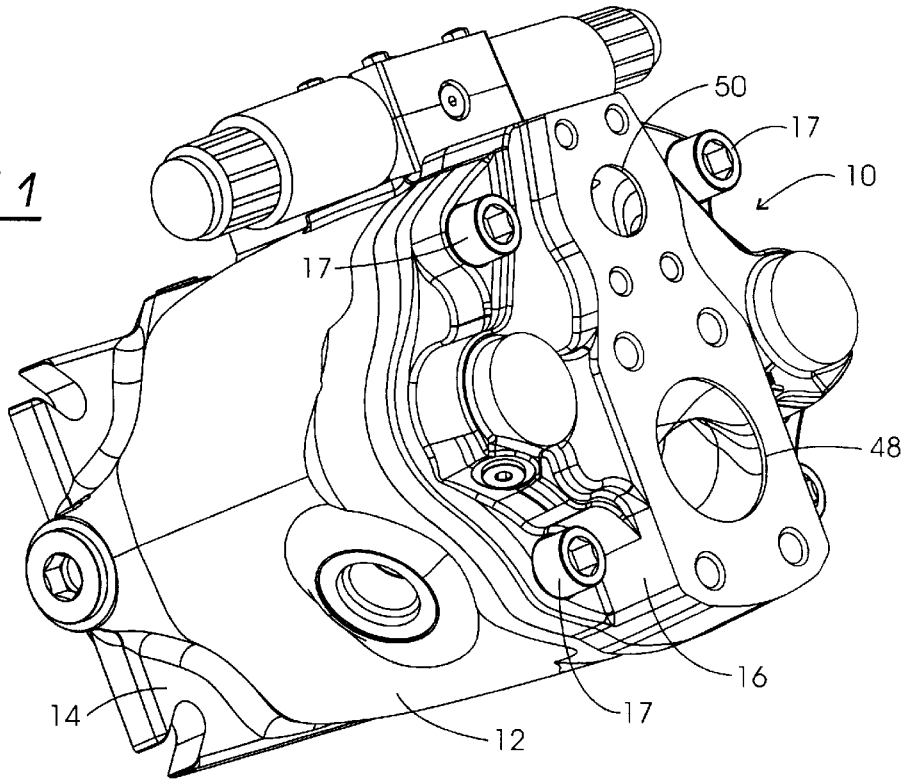
FIG. 1 is a perspective view of a rocker cam type pump which incorporates a preferred embodiment of the instant invention looking at the pump intake and discharge ports.

FIGS. 1 through 4 of the drawings disclose construction details of a typical pressure-compensated, variable displacement, axial piston pump 10 to which the present invention has found application. Pump 10 has a rocker cam pivotally mounted in a cam support or cradle may be seen to include a central pump housing 12, having a mounting pilot end 14 and a port cap 16 at the other end. Bolts 17 connect port cap 16 to housing 12.

Housing 12 defines a cavity which houses a rotatable barrel 18 mounted on a drive shaft 20. The inner end of drive shaft 20 is supported in a bearing 22 mounted in the port cap 16. Drive shaft 20 also is supported in a bearing 24 mounted within pump housing 12 and has a splined drive end 26 which projects outwardly of pump housing 12.

Barrel 18 has a plurality of bores 28 equally spaced circumferentially about its rotational axis. Each bore 28 contains a piston 30 having a ball shaped head 32. A shoe 34 is swaged onto head 32 of piston 30 such that the shoe can pivot about the end of the piston. Each of the shoes is clamped against a flat thrust plate or swash plate surface 36 formed on the face of a pivotal rocker cam 38 utilizing a conventional shoe retainer assembly of the type described in detail in U.S. Pat. No. 3,904,318 assigned to the predecessor in interest of the assignee of the subject invention.

Figure 2:
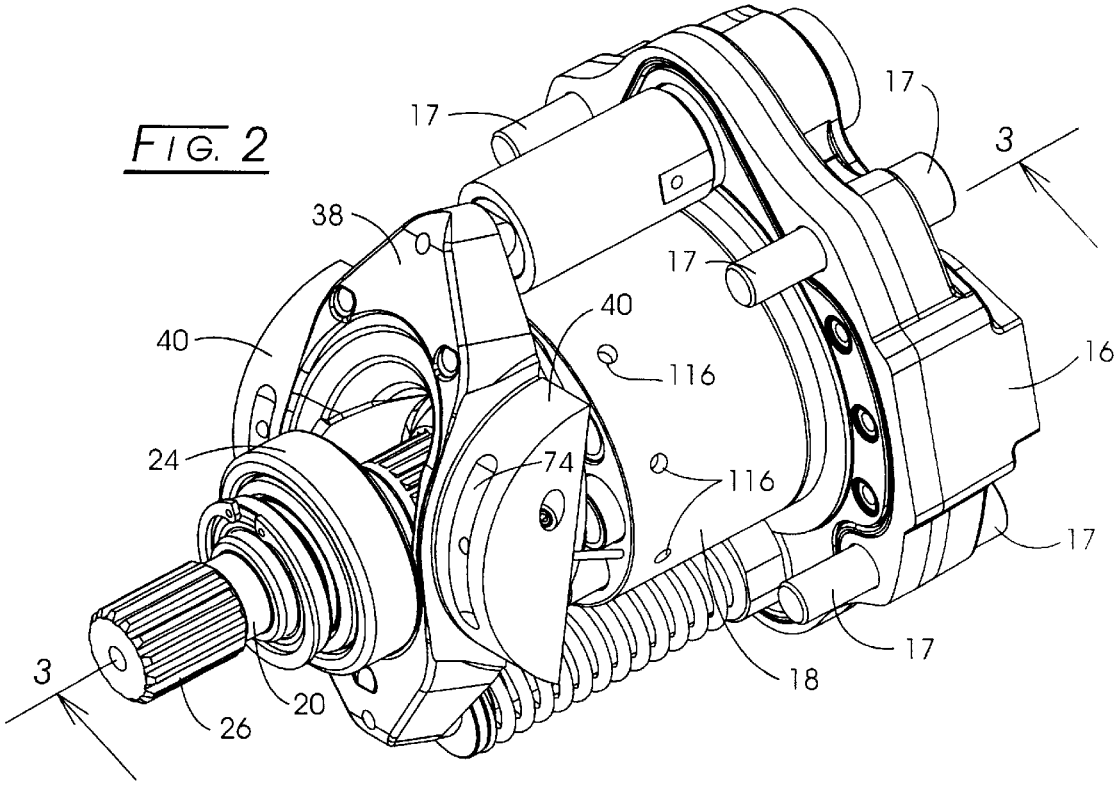
FIG. 2 is a perspective view of the pump of FIG. 1 with the pump housing removed to illustrate the pump variable-position rocker cam and other internal parts.
Figure 3:
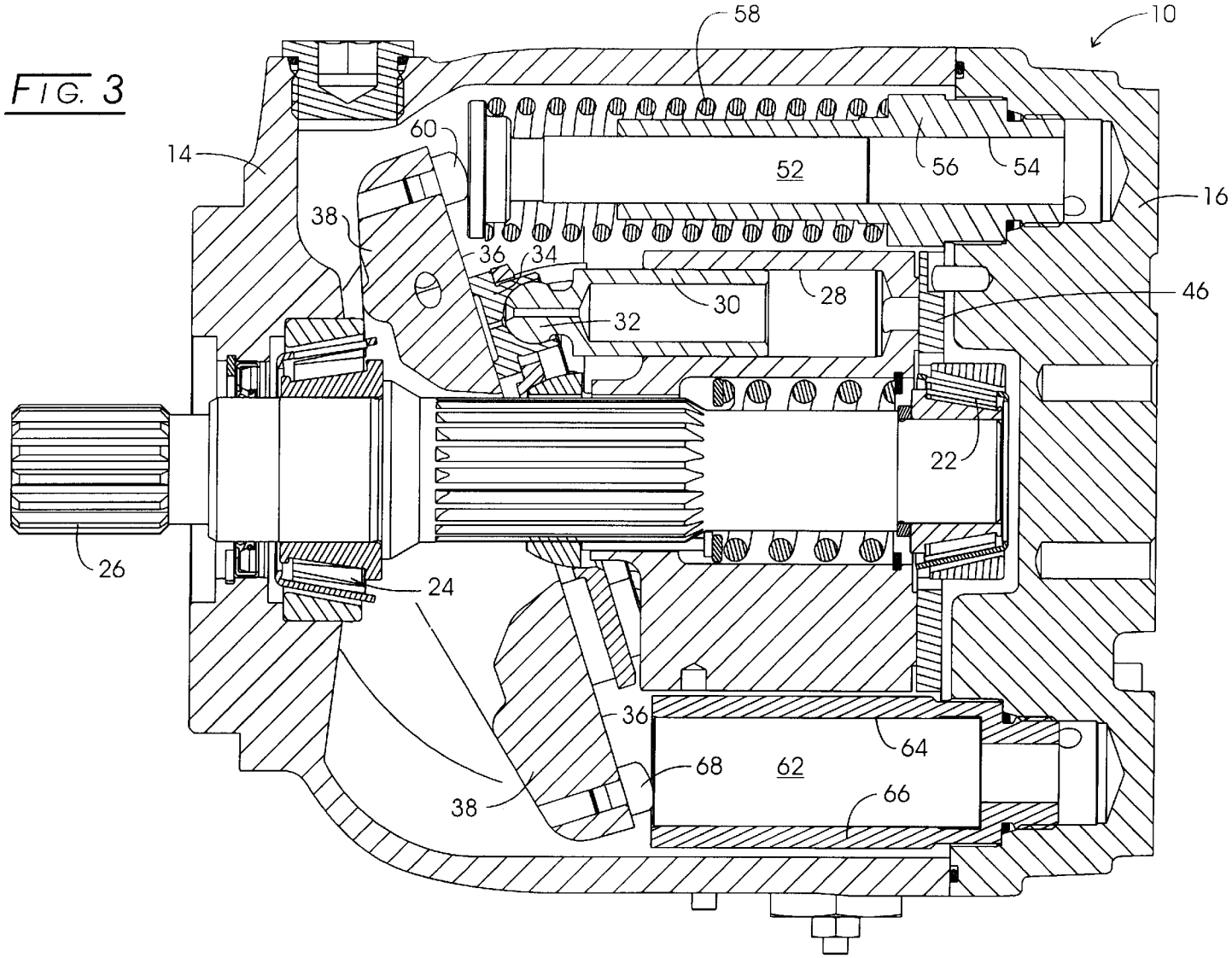
FIG. 3 is an axial sectional view of the FIG. 1 pump taken at lines 3—3 of FIG. 2.
Figure 4:
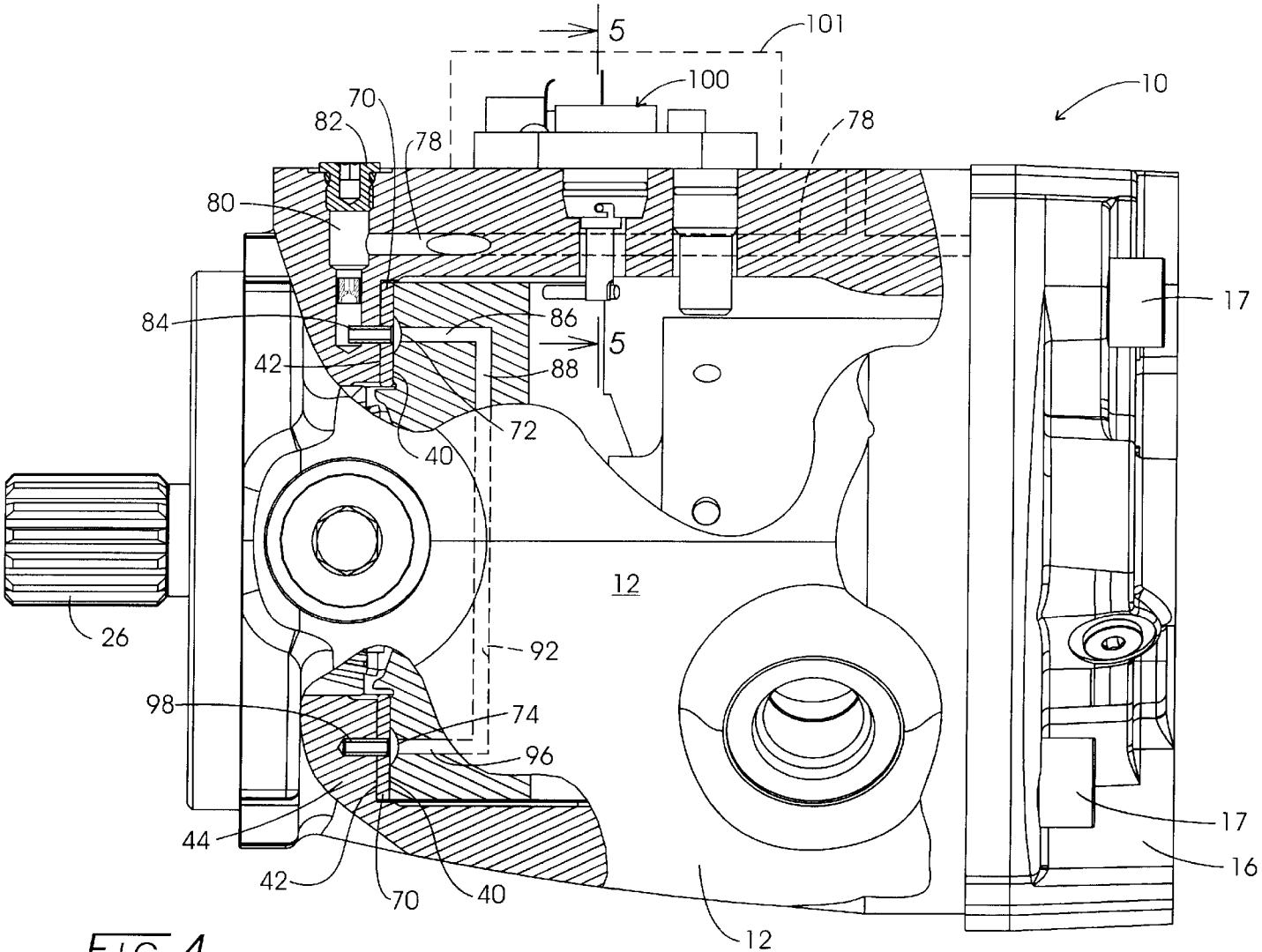
FIG. 4 is a side view, partially sectioned, of the pump of FIG. 1.
Figure 5:
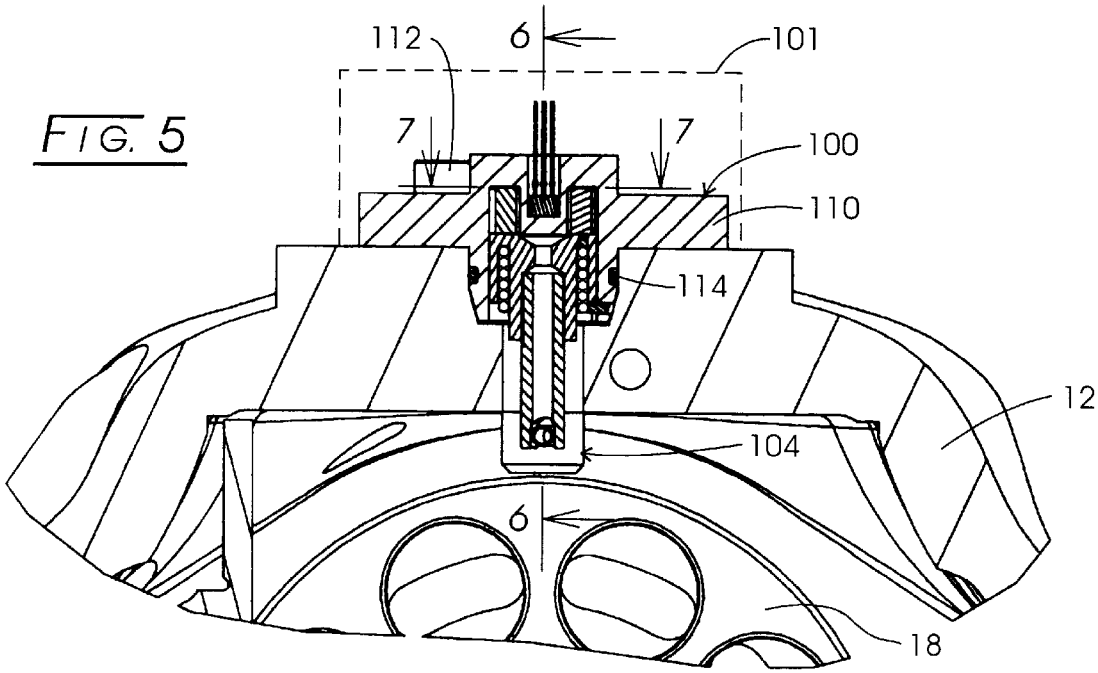
FIG. 5 is a section view taken at line 5—5 of FIG. 4.
Figure 6:
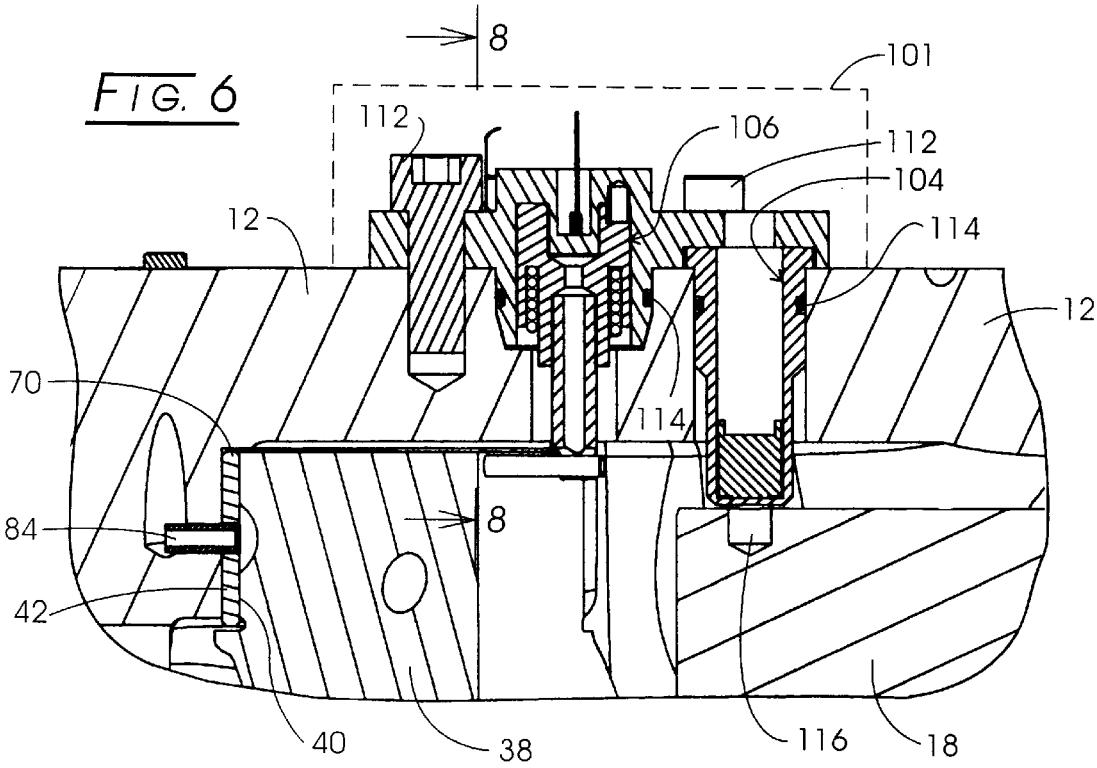
FIG. 6 is a section view taken at line 6—6 of FIG. 5.
Figure 7:
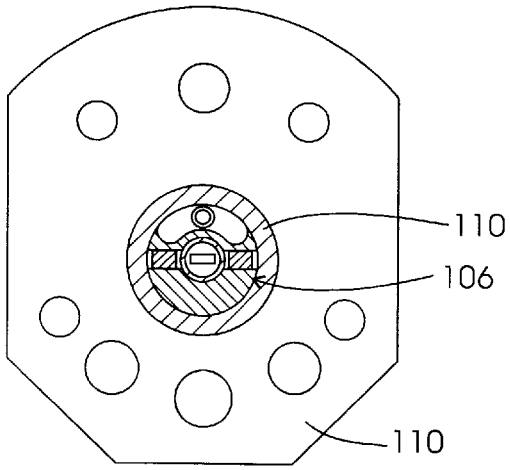
FIG. 7 is a section view taken at line 7—7 of FIG. 5.
Figure 8:
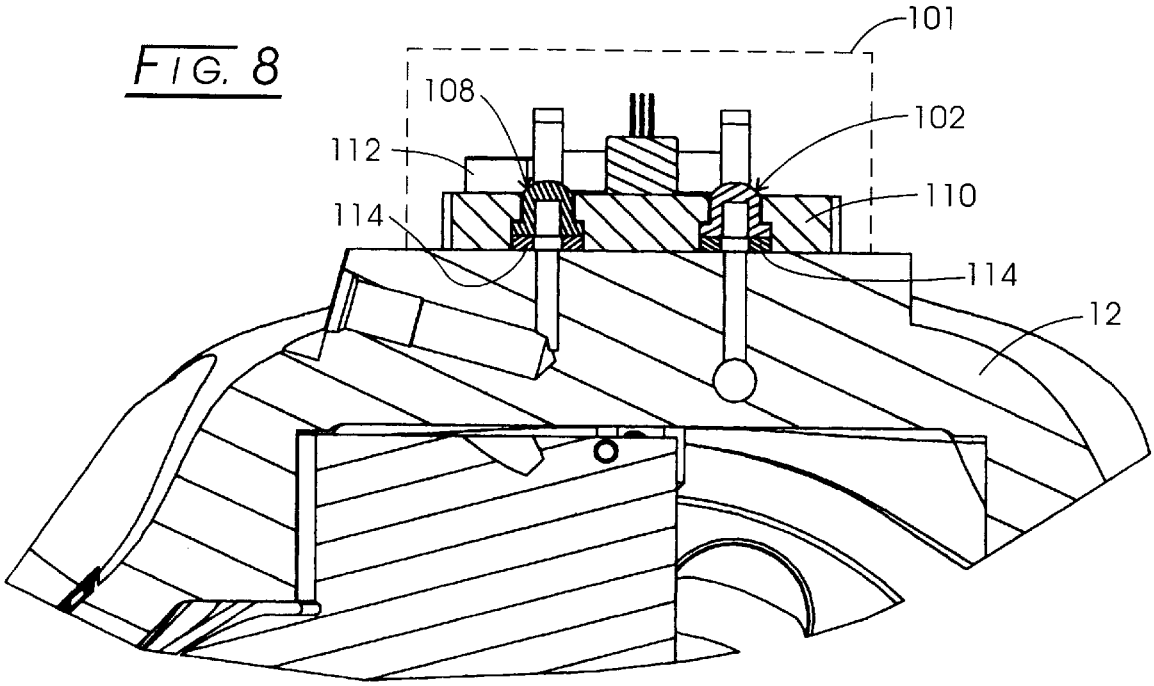
FIG. 8 is a section view taken at line 8—8 of FIG. 6.

Turning to FIGS. 2 through 4, it may be seen that rocker cam 38 has a pair of arcuate bearing surfaces 40 which are received in complementary arcuate bearing surfaces 42 which comprise a rocker cam support or cradle 44 formed in mounting pilot end 14 in pump housing 12. Rocker cam 38 pivots about a fixed axis perpendicular to the axis of rotation of barrel 18 to change the displacement of pump 10. In operation, the prime mover, not shown, affixed to spline drive end 26 rotates drive shaft 20 and barrel 18 within pump housing 12. When thrust surface 36 on the rocker cam 38 is perpendicular to the axis of rotation of barrel 18, rotation of barrel 18 will cause the shoes to slide across the surface of thrust surface 36 but no pumping action will occur inasmuch as the pistons 30 will not reciprocate within bores 28. In other words, when thrust surface 36 is perpendicular to the axis of drive shaft 20, the pump is in a position of minimum fluid displacement. As rocker cam 38 and thrust surface 36 are inclined from this position, the pistons 30 will reciprocate within bores 28 as shoes 34 slide over the surface of thrust plate 36. As the pistons 30 move inwardly of bores 28 i.e. away from port plate 46, low pressure fluid is drawn into cylinder bores 28 from inlet port 48. As piston shoes 34 slide across thrust surface 36 and move toward port plate 46, high pressure fluid is expelled through outlet port 50. It should be noted that fluid displacement increases as the angle of inclination of thrust surface 36 increases.

Referring to FIG. 3, it may be seen that rocker cam 38 and thrust surface 36 are shown in a position of maximum fluid displacement. Rocker cam 38 may be pivoted clockwise to reduce the displacement of pump 10. Although, pump 10 of the instant invention embodiment is depicted as a pressure-compensated pump which does not cross center, the instant invention described below applies equally to a rocker cam type variable displacement axial piston where rocker cam 38 may be pivoted clockwise across center such that the intake and exhaust ports are reversed and the device is providing maximum fluid displacement in the opposite direction. Such a pump may be seen in U.S. Pat. No. 5,076,145 assigned to the predecessor in interest of the subject invention. The instant invention also applies equally to a rocker cam type, variable displacement pump having a rotary servo or linear servo type control.

In the instant embodiment, in which pump 10 is depicted as a pressure compensated device, a piston 52 is slidably mounted in a bore 54 formed in a cylinder 56 rigidly mounted within port cap 16. A spring 58 around cylinder 56 biases piston 52 against a button 60 mounted on one side of rocker cam 38 to force the rocker cam to pivot to a position of maximum fluid displacement. A stroking piston 62 is slidably mounted in a bore 64 of a cylinder 66 rigidly secured in port cap 16 at a position within pump housing 12 diametrically opposite that of biasing piston 52. Stroking piston 62 engages a button 68 mounted in rocker cam 38 at a position diametrically opposite that of button 60.

In a pressure-compensated pump it is necessary to reduce the displacement of the pump when the pressure of the discharge fluid becomes excessive. When this condition occurs, pressure fluid is supplied to the end of stroking piston 62 to force it to move outwardly of bore 64 and thereby cause rocker cam 38 to pivot clockwise (as viewed in FIG. 3) towards a position of reduced fluid displacement. Stroking piston 62 will continue to pivot rocker cam 38 until such time as the discharge pressure of working fluid falls below a maximum setting. When this occurs, pressure fluid no longer is supplied to stroking piston 62 and biasing spring 58 moves stroking piston 62 outwardly to thereby pivot rocker cam 38 in a counterclockwise direction and thereby increase the displacement of the pump. Inasmuch as the instant invention is for any type of rocker cam type pump independent of its displacement control, a further description of the pressure compensated mechanism of pump 10 is not required.

As mentioned above, when rocker cam 38 is pivoted counterclockwise sufficiently to cause working pressure fluid to be expelled from pump 10 at a relatively high pressure, large pumping forces are exerted through pistons 30 to rocker cam 38. These forces are transmitted through the complementary arcuate bearing surfaces 40 and 42 into rocker cam support 44. The large pumping forces cause large friction forces to occur at the interface of rocker cam bearing surfaces 40 and rocker support bearing surfaces 40 and rocker support bearing surfaces 42 to make movement of rocker cam 38 within rocker support 44 very difficult. In an attempt to reduce the friction forces between rocker cam 38 and rocker support 44 plain bushings 70 are inserted between rocker cam arcuate bearing surfaces 40 and rocker support arcuate bearing surfaces 42 as depicted in FIG. 4. While plain bushings 70 reduce the aforementioned frictional forces to some extent, they are inadequate by themselves to reduce the frictional forces to a satisfactory level.

Accordingly, working pressure fluid is supplied to counterbalance pockets 72 and 74 formed in the rear faces 76 of rocker cam 38 as depicted in FIGS. in 2 and 4. The areas of the counterbalance pockets 72 and 74 are designed such that when they receive working pressure fluid they reduce the force required to pivot rocker cam 38 within cam support 44 to within desirable levels. Heretofore, working pressure fluid has been supplied to counterbalance pockets in rocker cam where the working pressure fluid source is a pumping piston and fluid is supplied to the piston shoe and thereafter to bores in the thrust plate which bores connect to the counterbalance pockets.

Pump 10 has a unique means for supplying working pressure fluid to the counterbalanced pockets 72 and 74 formed in the rear face 76 of rocker cam 38 where the fluid source is in pump housing 12.

Turning to the FIG. 4, it may be seen that a fluid passage 78 connected to a source, not shown, of working pressure fluid is formed in pump housing 12. Fluid passage 78 opens into fluid passage 80 formed in pump housing 12, one end of which is closed by a plug 82 which may be replaced with a sensor or other device utilizing working pressure fluid for control purposes.

A hollow roll pin 84 is mounted in a central bore of plain bushing 70, in cam support arcuate bearing surface 42 and in a corresponding bore in housing 12. Roll pin 84 serves two purposes. It anchors plain bushing 70 on cam support or cradle 44 and it intersects fluid passage 80 to thereby connect that passage to a fluid passage 86 formed in rocker cam 38 and in arcuate cam surface 40. Fluid passage 86 intersects an angled fluid passage 88 formed in rocker cam 38. Fluid passage 88 intersects an oppositely angled passage 92. The fluid passage 96 which parallels fluid passage 86 has one end which intersects fluid passage 92 at a right angle and another end which opens into fluid pocket 74 formed in rear face 76 of rocker cam 38. Turning to FIG. 4, it may be seen that a roll pin 98 anchors plain bushing 70 to cam support surface 44.

As indicated initially, the present invention includes an installation of sensor assemblies, designated 100 in the drawings, which is combined with pump 10 to facilitate the measurement of pump operating performance. A pump control block 101 overlies and is electrically connected to said sensor assemblies 100. The sensor assembly installation preferably includes a pump output or working fluid pressure sensor assembly 102, a pump rate of rotation sensor assembly 104, a pump piston thrust plate cam angular position sensor assembly 106, and, optionally, a load fluid pressure sensor assembly 108 that senses the magnitude of a system feedback pressure utilized for adjustment control of the piston thrust plate angular position. Such sensor assemblies are partially contained within position sensor housing 110 (which in turn is removably secured to pump housing 12 using the screw fasteners referenced by the numeral 112), and are partially contained within pump housing 12 using circular static fluid pressure seals 114 exclusively. Such static fluid pressure seals are preferably "O-ring"-type resilient synthetic rubber fluid pressure seals that surround and are compressed against included non-rotating sensor assembly body elements or housing elements to thereby eliminate leakage of high-pressure hydraulic fluid that would otherwise potentially arise out of seal wear due to seal erosion.

Although various different types of position, speed, and pressure sensors may be incorporated in the present invention, the drawings illustrate only conventional forms of such devices. Specifically, speed sensor 104 is a conventional, Hall-effect type of electromagnetic sensor that detects uniformly-spaced blind hole discontinuities 116 provided in the surface of pump barrel element 18, and provides output pulses that are used in pump rotation rate and volumetric pumping rate computations. Position sensor 106 also is a Hall-effect electromagnetic sensor with the included permanent magnets. The spaced and position sensors 104 and 106 may be any type of electromagnetic sensors. Fluid pressure sensors 102 and 108 are conventional strain gage bridge type devices.

Various changes in size, proportions, or material of construction may be incorporated into the different invention elements described herein without departing from the meaning, scope, or intent of the claim which follows.

We claim as our invention:

1. In a variable-displacement hydraulic pump having a pump housing and having contained within the pump housing a rotationally-driven pump barrel, multiple, variable stroke, fluid-pumping pistons contained within the rotationally-driven pump barrel, and an angularly-positioned piston thrust plate that co-operates with the fluid-pumping pistons, in combination:

a position sensor housing removably secured to the pump housing;

an electromagnetic position sensor assembly partially contained within said position sensor housing, partially contained within the pump housing;

an electromagnetic rotational speed sensor assembly partially contained within said position sensor housing, partially contained within the pump housing, and positioned to sense surface discontinuities in the rotationally-driven pump barrel;

a hydraulic fluid pressure sensor assembly partially contained within said position sensor housing; and multiple resilient fluid pressure seals engaging only static surfaces of each said sensor assemblies, said electromagnetic position sensor assembly, said electromagnetic rotational speed sensor assembly, and said hydraulic fluid pressure sensor assembly each having a respective static resilient pressure seal that is compressed sufficiently to preclude the leakage of pressurized hydraulic fluid to regions positioned between said position sensor housing and the pump housing.

* * * * *